US006247981B1

(12) United States Patent
Farley et al.

(10) Patent No.: US 6,247,981 B1
(45) Date of Patent: Jun. 19, 2001

(54) RECREATIONAL WATERCRAFT

(75) Inventors: Nicolas Farley, St. Lambert; Pierre Farley, Laval, both of (CA)

(73) Assignee: Farley Ice Technologies Inc., Montreal (CA)

( * ) Notice: Subject to any disclaimer, the term of this patent is extended or adjusted under 35 U.S.C. 154(b) by 0 days.

(21) Appl. No.: 09/449,755

(22) Filed: Nov. 26, 1999

(30) Foreign Application Priority Data

Oct. 18, 1999 (CA) ..... 2286636

(51) Int. Cl.[7] ..... B63H 1/04

(52) U.S. Cl. ..... 440/90; 114/123; 440/27

(58) Field of Search ..... 114/355–357, 360, 114/68, 361, 362, 65 R, 58, 123; 440/90, 91, 98–100, 21, 26, 27, 28, 29, 30; 416/84, 86; D12/306

(56) References Cited

U.S. PATENT DOCUMENTS

| | | | |
|---|---|---|---|
| D. 145,884 | | 11/1946 | Consiglio . |
| D. 235,531 | | 6/1975 | Bernard . |
| 428,213 | | 5/1890 | Jarrell . |
| 453,704 | | 6/1891 | Pease . |
| 561,956 | | 6/1896 | Augur . |
| 626,304 | | 6/1899 | Schultz . |
| 792,687 | | 6/1905 | Woll . |
| 869,277 | | 10/1907 | Travland . |
| 876,385 | | 1/1908 | McIlwee . |
| 879,389 | | 2/1908 | Kreis . |
| 881,650 | | 3/1908 | Audet . |
| 1,024,419 | | 4/1912 | Resch . |
| 1,238,244 | | 8/1917 | Zaradzki . |
| 1,741,879 | | 12/1929 | Rathbone et al. . |
| 2,165,745 | | 7/1939 | Canton . |
| 2,257,698 | | 9/1941 | McCombie . |
| 2,309,875 | * | 2/1943 | Thompson ..... 440/100 |
| 2,357,084 | | 8/1944 | Cleofe . |
| 2,998,798 | | 9/1961 | Love . |
| 3,083,677 | | 4/1963 | Deubelbeiss . |

(List continued on next page.)

FOREIGN PATENT DOCUMENTS

| | | |
|---|---|---|
| 120454 | 12/1930 | (AT) . |
| 383272 | 3/1908 | (FR) . |
| 1541332 | 8/1968 | (FR) . |
| 2236992 | 4/1991 | (GB) . |
| 1276-564 | 12/1986 | (SE) . |

OTHER PUBLICATIONS

Publication of "Paddle–Wheel Boat" by Dick Hixon in *Popular Science*, Aug. 1940, p. 139.

Publication of "Shallow Draft Bass Boat" by Hi Sibley in *B O A T S*, Aug. 1952, pp. 149–151.

*Primary Examiner*—Ed Swinehart
(74) *Attorney, Agent, or Firm*—Swabey Ogilvy Renault; Michel Sofia

(57) ABSTRACT

A manually powered recreational watercraft comprises a hull and a pair of paddle wheels independently mounted on opposed sides of the hull. Each paddle wheel comprises a plurality of vanes circumferentially distributed on a semi-spherical hub having an inboard flange. Each paddle wheel has a buoyant structure to provide additional lateral floatation stability to the watercraft. The vanes, the hub and the inboard flange of each paddle wheel are configured so that, upon rotation of the paddle wheel, water bubbles trapped between submerged adjacent vanes are channeled upwardly to the water surface whereat the bubbles burst and provide audible sounds. Safety hand grips are provided in the underside of the hull to help a user to pull himself on the hull in the event that the watercraft capsized. A floating wind-shield is mounted to the hull so as to be automatically separated therefrom upon capsizing of the watercraft.

17 Claims, 6 Drawing Sheets

U.S. PATENT DOCUMENTS

| | | | | |
|---|---|---|---|---|
| 3,101,489 | * | 8/1963 | Chance | 114/348 |
| 3,467,049 | | 9/1969 | Turcotte . | |
| 3,680,522 | | 8/1972 | Clark et al. . | |
| 4,003,099 | * | 1/1977 | Hivko | 114/355 |
| 4,493,658 | | 1/1985 | Hildebrand . | |
| 4,500,297 | | 2/1985 | Boulva . | |
| 4,631,037 | * | 12/1986 | Dickens | 440/100 |
| 4,668,196 | | 5/1987 | Billmayer et al. . | |
| 4,979,916 | | 12/1990 | LeBlanc . | |
| 5,071,378 | | 12/1991 | Wang . | |
| 5,110,313 | | 5/1992 | Po . | |
| 5,248,271 | | 9/1993 | Chu . | |
| 5,381,752 | | 1/1995 | Eerdmans . | |
| 5,427,554 | | 6/1995 | Foglia . | |
| 5,501,072 | | 3/1996 | Plancich et al. . | |
| 5,785,564 | | 7/1998 | Von Ohain et al. . | |

* cited by examiner

RECREATIONAL WATERCRAFT

BACKGROUND OF THE INVENTION

1. Field of the Invention

The present invention relates to recreational watercrafts and, more particularly, to watercrafts suited for use by children.

2. Description of the Prior Art

Paddle wheel propelled watercrafts suited for use by children are well known in the art. For instance, U.S. Pat. No. 4,500,297 issued on Feb. 19, 1985 to Boulva discloses a small watercraft comprising a main floating body propelled by floatable paddle wheels mounted on opposed sides of the main floatation body at the front end thereof. The paddle wheels are mounted on a common crank shaft which is removably mounted to the main floatation body. Each paddle wheel comprises a plurality of radially extending paddles integrally formed on the circumference of a generally cylindrical hollow hub portion. The opposed sides of each paddle wheel are substantially flat.

U.S. Pat. No. 5,427,554 issued on Jun. 27, 1995 to Foglia discloses a watercraft comprising a central floating body on opposed sides of which two paddle wheels are independently mounted to propel and steer the watercraft on a water surface. Each paddle wheel comprises a plurality of paddles circumferentially distributed on the outboard surface of a disc mounted to an axle journaled to a bearing secured to an outrigger float which, in turn, is connected to the central floating body.

Although the recreational watercrafts disclosed in the above mentioned patents are suited for use by children, there is still a need for a new and enjoyable watercraft which can be safely used by a child.

SUMMARY OF THE INVENTION

It is therefore an aim of the present invention to provide a recreational watercraft which is relatively safe for use by children.

It is also an aim of the present invention to provide a recreational watercraft having improved floating stability.

It is a further aim of the present invention to provide a recreational watercraft which is relatively simple and economical to manufacture.

It is still a further aim of the present invention to provide a watercraft which can be compactly stored.

It is a further aim of the present invention to provide a new paddle wheel design.

It is still a further aim of the present invention to provide a new paddle wheel which is adapted to produce audible sound effects while being operated in water.

Therefore, in accordance with the present invention, there is provided a recreational watercraft comprising a hull and a propulsion unit for propelling said hull on a water surface, said propulsion unit comprising a pair of paddle wheels laterally mounted on opposed sides of said hull, each said paddle wheel including a plurality of vanes circumferentially distributed on a buoyant bulged hub structure projecting laterally outwardly of said hull, each said buoyant bulged hub structure acting as an outrigger float to provide additional lateral flotation stability.

Also in accordance with the present invention, there is provided a watercraft paddle wheel comprising a plurality of radially extending vanes circumferentially distributed on an outer semi-spherical surface of a hub structure.

Further in accordance with the present invention, there is provided a recreational watercraft comprising a floating hull having an outer surface, and at least one safety hand grip integrated in a recess formed in said outer surface at a location accessible to a user when said floating hull is overturned to an inverted position with a top surface thereof underneath, whereby a user can grasp said safety hand grip to pull himself out of the water in the event that said floating hull is overturned.

Still further in accordance with the present invention, there is provided a recreational watercraft comprising a hull and a windshield detachably mounted to said hull so as to be automatically separated therefrom upon capsizing of said hull, said windshield being formed as a float to support a user on a water surface independently of said hull.

Still further in accordance with the present invention, there is provided a paddle wheel for propelling a recreational watercraft through water, comprising a plurality of radially extending paddles circumferentially distributed on an outer surface of a hub structure, said outer surface cooperating with said paddles to constrictly channel bubbles trapped between submerged adjacent paddles upwardly to a water surface where the bubbles burst, thereby producing audible bursting sounds as said paddle wheel is operated in the water.

Still further in accordance with the present invention, there is provided a kit for a recreational watercraft comprising a hull defining a cockpit adapted to receive a child, a propeller assembly including a pair of paddle wheels adapted to be connected to said hull for propelling the same on a surface of water, said propeller assembly being sized and configured to be completely received within said cockpit for compact storage, and a windshield adapted to be removably mounted at a front end of said cockpit, said windshield being sized and configured to be fitted in superposition upon an outer surface of said hull to allow said recreational watercraft to be stored and shipped in a minimum of space.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
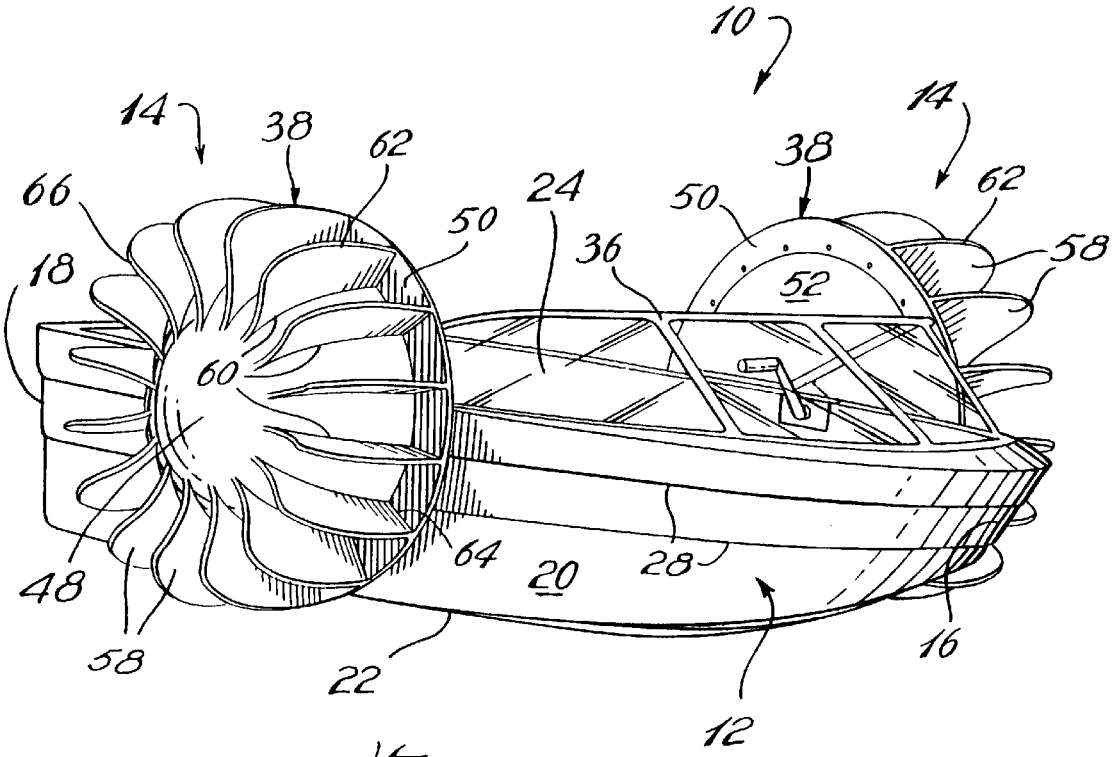
FIG. 1 is a perspective view of a manually propelled recreational watercraft in accordance with a first embodiment of the present invention.

Now referring to the drawings, and in particular to FIG. 1, a recreational watercraft embodying the elements of the present invention and generally designated by numeral 10 will be described.

More particularly, the recreational watercraft 10 comprises a floating hull 12 and a pair of propellers 14 independently mounted on opposed sides of the hull 12 for propelling and steering the watercraft 10 on a water surface. By rotating the propellers 14 at different speeds or in different directions, the watercraft 10 can be readily steered in any desired direction.

Figure 2:
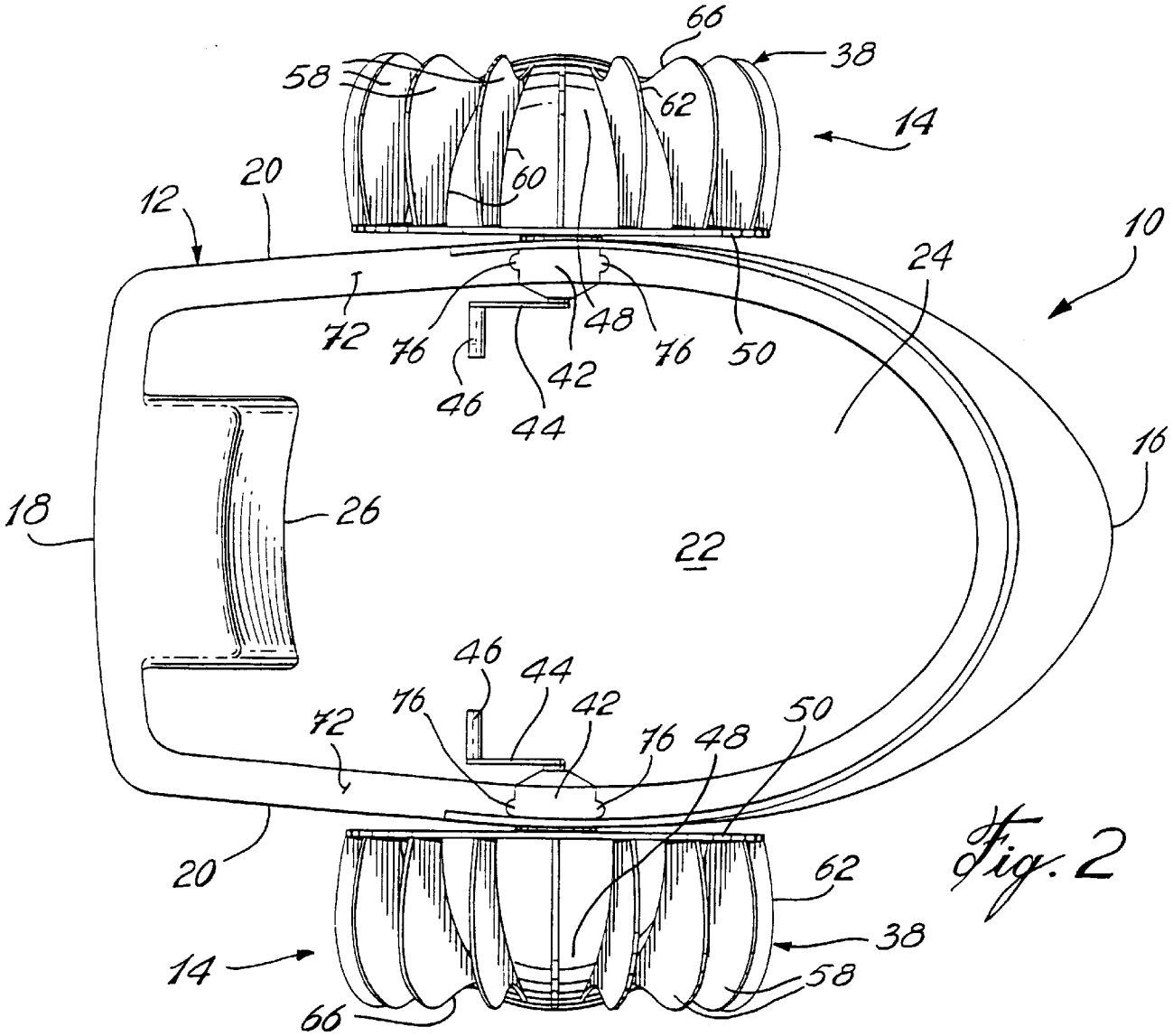
FIG. 2 is a top plan view of the recreational watercraft of FIG. 1.
Figure 3:
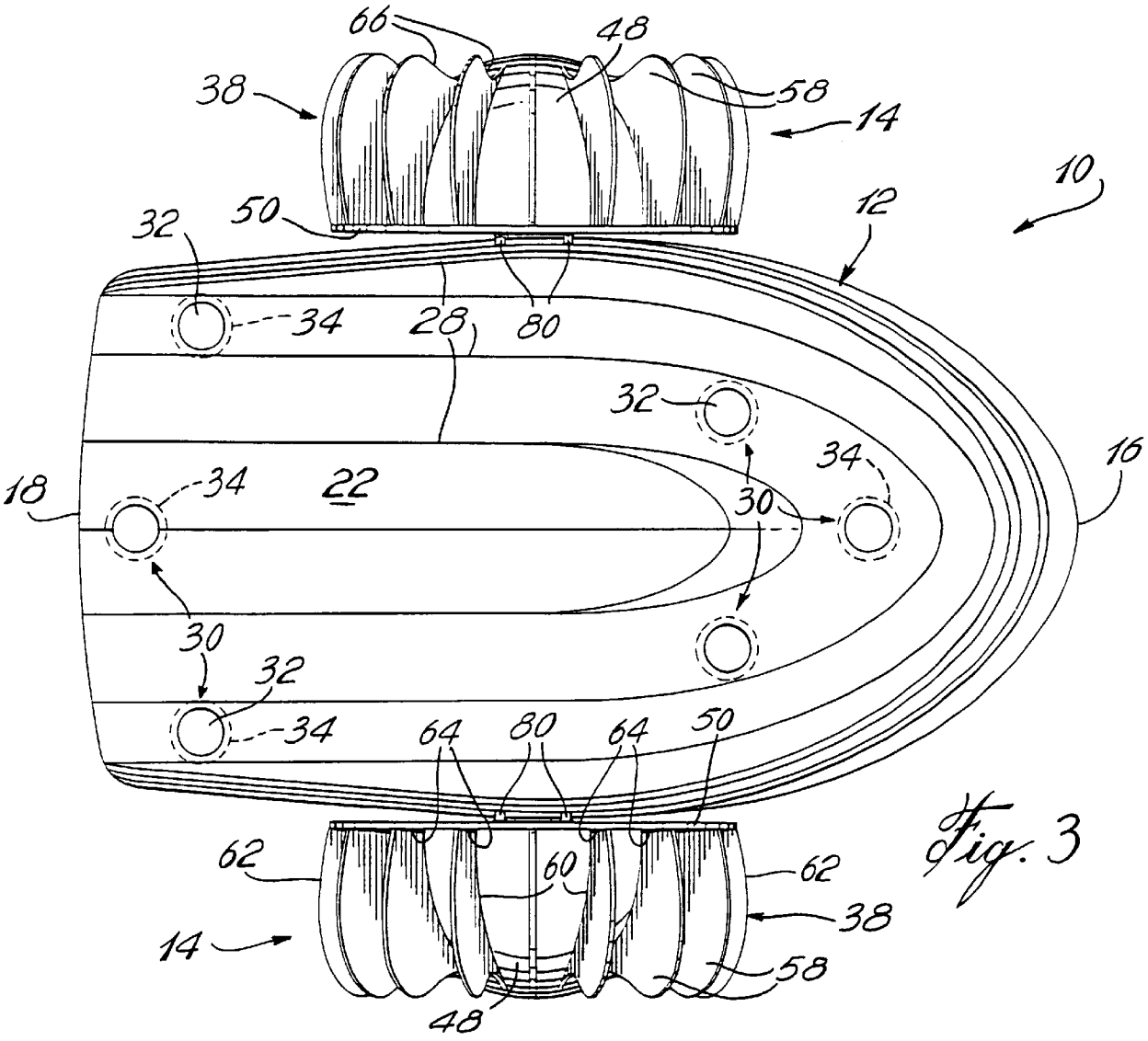
FIG. 3 is a bottom plan view of the recreational watercraft of FIG. 1, illustrating the disposition of a number of safety hand grips formed in the underside of the watercraft.

The hull 12 is provided in the form of a lightweight hollow floating body which is integrally molded from a polymeric material. According to a preferred embodiment of the present invention, the hull 12 is of a seamless unitized construction and is obtained by a blow molding process. The seamless unitized construction advantageously eliminates the possibilities that water seeps into the enclosed internal space of the hull 12, thereby contributing to increasing the service life of the hull 12. As seen in FIGS. 1 to 3, the hull 12 includes raised bow and stern portions 16 and 18, respectively, which are integrally connected to each other by a pair of side walls 20 extending integrally upwardly from opposed longitudinal sides of a bottom wall 22. The bottom wall 22, the side walls 20 and the raised bow and stern portions 16 and 18 define a recessed cockpit 24 in which a child can take place. The cockpit 24 provides a safe environment wherein the child is completely surrounded by the floating structure of the hull 12. A back rest 26 is integrally formed in the raised stern portion 18 of the hull 12 to support the child seated in the cockpit 24. The side walls 20 and the bottom wall 22 can be corrugated, such as at 28, in order to improve the structural properties thereof, as is well known in the art.

Figure 6:
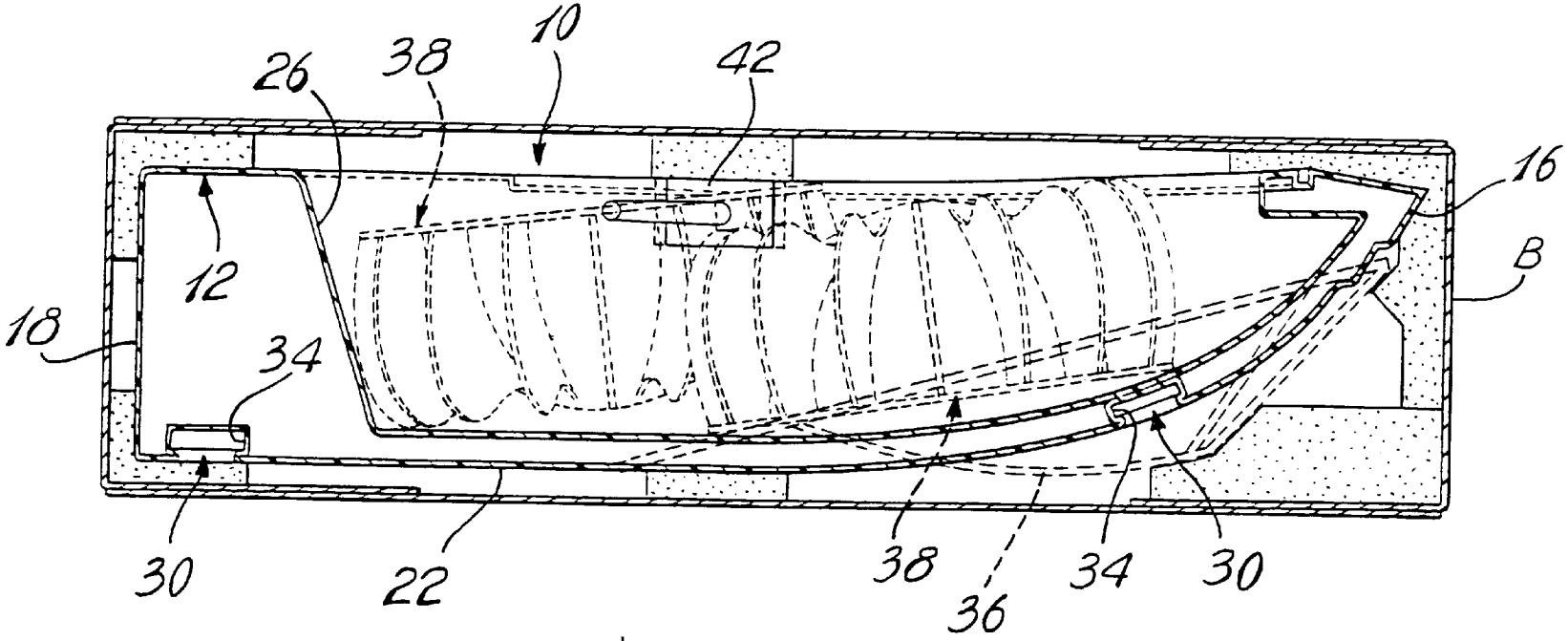
FIG. 6 is a schematic side view of a disassembled watercraft stored within a rectangular box.

As seen in FIGS. 3 and 6, a number of spaced-apart safety hand grips 30 are provided at selected locations in the underside of the bottom wall 22 of the hull 12 so as to be readily accessible to the child in the event that the watercraft 10 capsizes. In such a situation where the hull 12 is in an inverted position with a top surface thereof underneath, the safety hand grips 30 can be grasped by the child to pull himself out of the water onto the inverted watercraft 10. Each safety hand grip 30 is integrated in a recess 32 formed in the underside of the bottom wall 22. More particularly, each safety hand grip 30 is formed by punching a selected portion of the underside of the bottom wall 22 inwardly and by deforming the punched portion laterally outwardly to form an internal gripping flange 34 at the mouth of the resulting recess 32. By so integrating the safety hand grips 30 in the underside of the bottom wall 22, the force of the water resistance acting against the hull 12 as the same moves through the water is not increased and, thus, the hydrodynamic performances of the hull 12 are advantageously preserved. It is understood that the safety hand grips 30 could also be provided, for instance, in the outer surface of the side walls 20, as long as they remain accessible when the watercraft 10 is turned over.

As seen in FIG. 1, a windshield 36 can be provided at the front end of the cockpit 24 to give to the watercraft 10 the appearance of a yacht. The windshield 36 has a hollow buoyant structure and is mounted to the hull 12 so as to be automatically separated therefrom upon capsizing of the watercraft 10. Accordingly, in the event that the hull 12 overturns, the child will have the opportunity to use the windshield 36 as a floater to support him on the water. The windshield 36 can be blow molded from a polymeric material. According to a preferred embodiment of the present invention, the windshield 36 is simply seated on the hull 12 and releasably retained in place by a conventional tenon and mortise arrangement. However, it is understood that other means can be used to detachably mount the windshield 36 to the hull 12.

Figure 4:
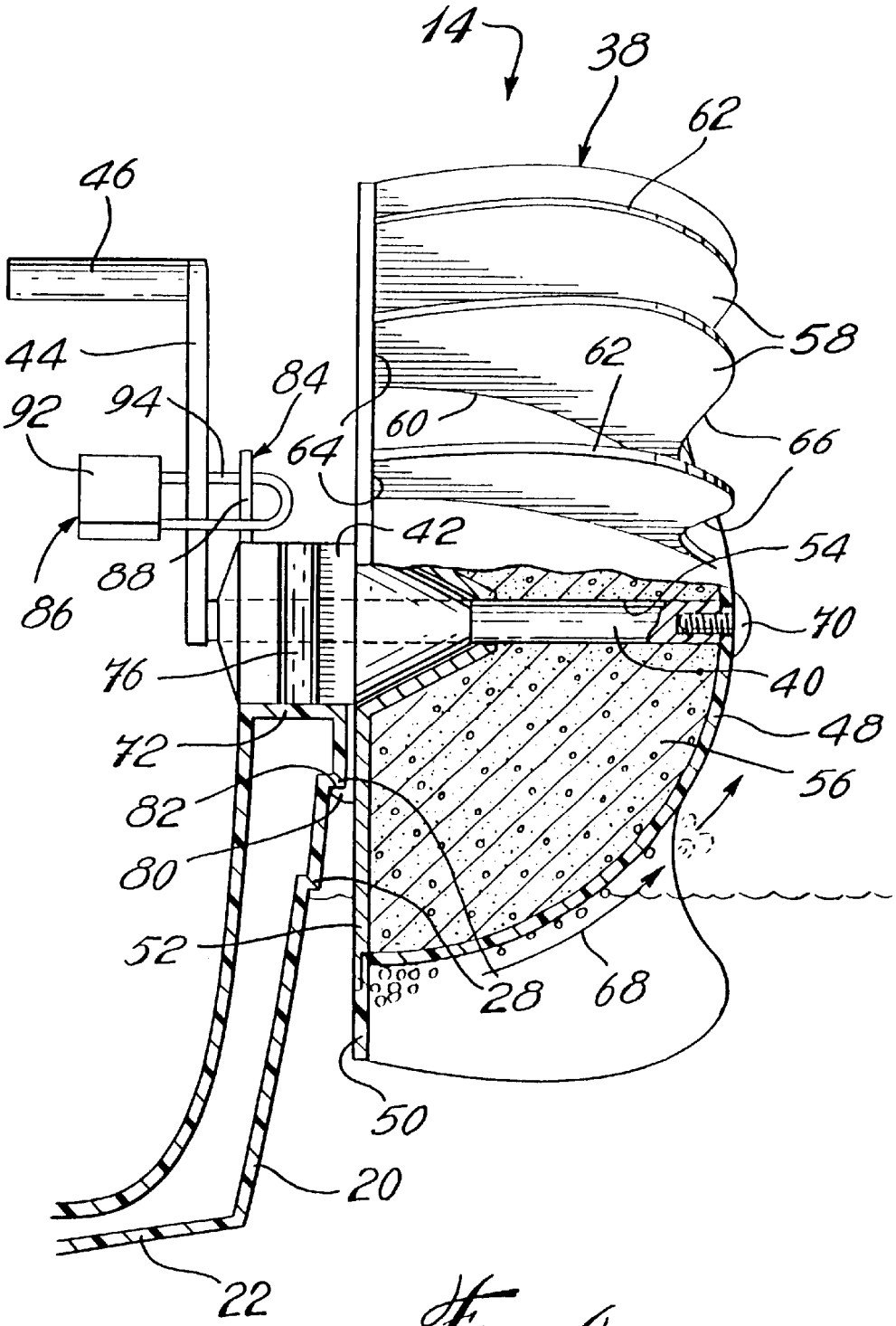
FIG. 4 is a side elevational view partly in cross section of a paddle wheel mounted on one side of the watercraft.

As seen in FIG. 4, each propeller 14 comprises a paddle wheel 38 mounted at the outboard end of an axle 40 for rotation therewith. The axle 40 is journaled in a replaceable bearing 42 removably mounted to a respective one of the side walls 20 of the hull 12. The inboard end of each axle 40 is provided with a crank 44 at the free end of which a handle 46 is secured for allowing the associated paddle wheel 38 to be manually powered by the child seated in the cockpit 24. The paddle wheels 38 are located approximately midway between the bow and stern portions 16 and 18 of the hull 12 so that the handles 46 can be easily grasped by the child for actuating the paddle wheels 38.

As seen in FIGS. 1 to 4, each paddle wheel 38 comprises a hollow semi-spherical outboard structure 48 with an integral ring-shaped flange 50 extending laterally outwardly from an inboard planar end thereof. As seen in FIG. 4, the internal space of the hollow semi-spherical outboard structure 48 is filled with a floating material 56, such as polystyrene. A central disc 52 is sealingly secured to the inboard surface of the flange 50 so as to enclose the floating material 56 into the hollow semi-spherical outboard structure 48. It is noted that the disc 52 can be screwed to the hollow semi-spherical outboard structure 48 or otherwise secured thereto. A central passage 54 is defined through the disc 52, the floating material 56 and the hollow semi-spherical outboard structure 48 for receiving therein one of the axles 40. According to a preferred embodiment of the present invention, the hollow semi-spherical outboard structure 48 is molded from a plastic material and the disc 52 is made of plywood. The floating material 56 provides a floating structure which cannot sink when punctured.

The semi-spherical shape and the disposition of the paddle wheels 38 with respect to the hull 12 advantageously contribute to increase the lateral floatation stability of the watercraft 10, thereby rendering the same safe for use by a child. Indeed, the paddles wheels 38 act as outrigger floats which render the watercraft 10 extremely difficult to overturn. Furthermore, the semi-spherical shape of the outboard structures 48 advantageously provides a hydrostatic pressure distribution which will tend to push the paddle wheels 38 against the sides of the hull 12 instead of inducing flexural stresses in the axles 40. Consequently, a smaller axle can be used for supporting each paddle wheel 38.

Each paddle wheel 38 further comprises a plurality of circumferentially spaced-apart paddles or vanes 58 extending integrally from the outer surface of the hollow semi-spherical outboard structure 48. Each vane 58 is substantially flat and has a radially innermost edge or root 60 and a radially outermost edge or tip 62 extending from an inner edge 64 to an outer edge 66. The root 60 of each vane 58 extends in a chordwise direction and follows the curvature of the semi-spherical outboard structure 48. The tip 62 of each vane 58 is slightly convex, whereas the outer edge 66 thereof forms a concave curve extending to the outer surface of the semi-spherical outboard structure 48. The inner edge 64 of each vane 58 is straight and extends to the outboard surface of the flange 50. The flange 50 isolates the vanes 58 from the occupant and, thus, contributes to prevent potential injury to the occupant. Furthermore, the flange 50 acts as a splash guard to prevent spilling towards the occupant as the vanes 58 leave the water.

In use, the unique design of the above described paddle wheels 38 provides for the production of audible bursting sounds which further contributes to amusing the children. As seen in FIG. 4, each pair of adjacent vanes 58 cooperates with the flange 50 and the semi-spherical outer surface of the outboard structure 48 to trap some air in the water. As indicated by arrow 68, the trapped air, which is in the form of bubbles, is channeled upwardly out of the water along a submerged portion of the outer surface of the semi-spherical outboard structure 48. The vanes 58 form with the semi-spherical outer surface of the outboard structure 48 and the flange 50 a plurality of constricted channels through which the trapped bubbles can be guided laterally upwardly on the outboard side of the paddle wheel 38. The channeled bubbles burst as they come out of the water thereby generating bursting sounds. By trapping and channeling the air in a constricted area extending upwardly to the water surface, the velocity of the expelled bubbles can be increased to amplify the resulting bursting sounds to a desired level.

As mentioned hereinbefore, each paddle wheel 38 is mounted to the associated axle 40 for rotation therewith. For instance, each paddle wheel 38 can be keyed to the associated axle 40 and axially retained thereon via a retaining cap 70 threadably engaged with the outboard end of the axle 40, as seen in FIG. 4. obviously, other mounting means could be used as well.

Figure 5:
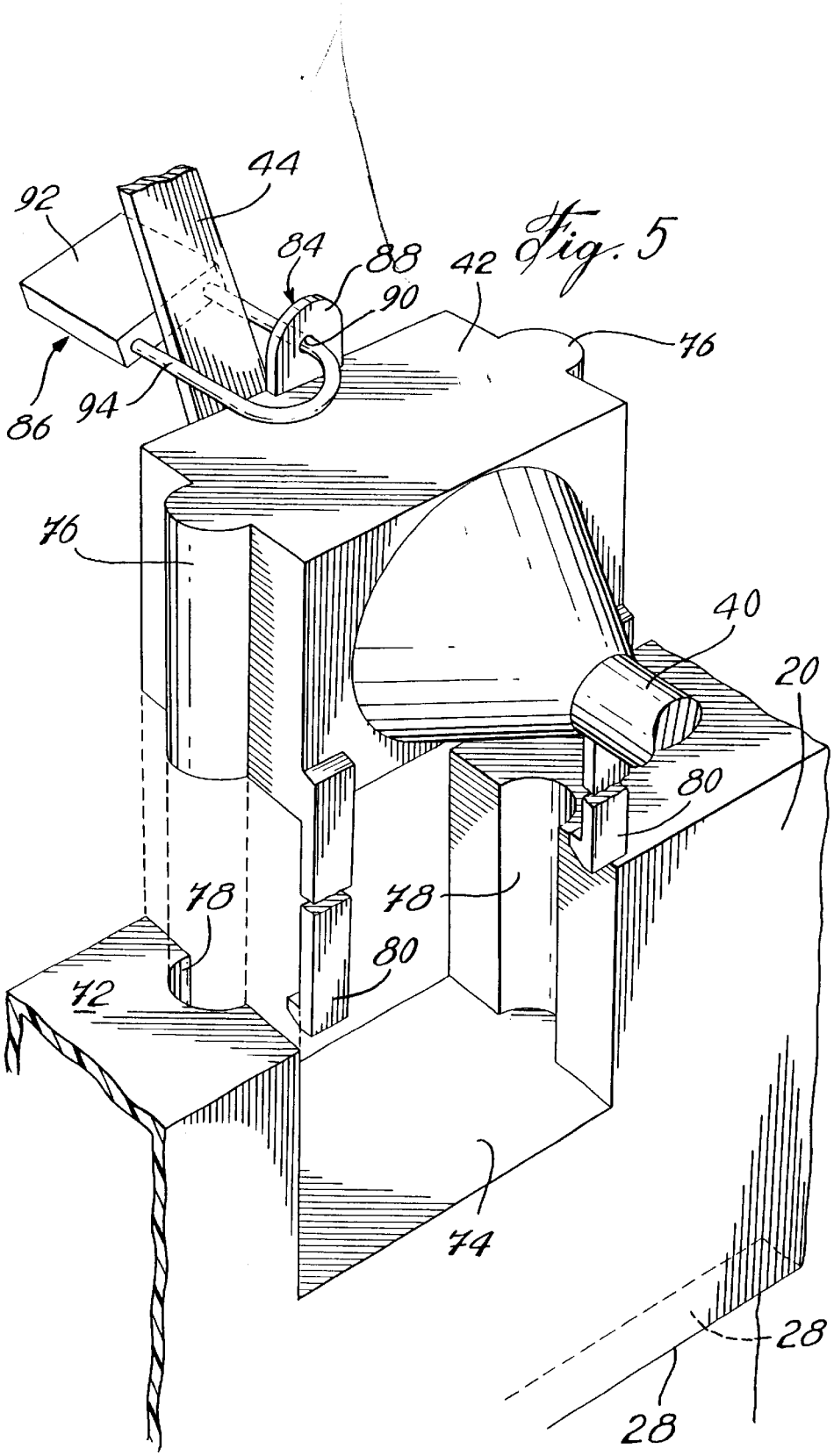
FIG. 5 is a perspective view of a removable bearing adapted to be mounted in a depression defined in a gunwale of the watercraft.

As seen in FIG. 5, each gunwale 72 of the hull 12 defines a depression 74 for receiving a corresponding one of the removable bearings 42 used to support the axles 40. Each removable bearing 42 comprises a pair of lateral securing ribs 76 adapted to be pressure fitted in corresponding spaced-apart recesses 78 defined in the depression 74. Each removable bearing 42 is further provided with a pair of downwardly depending resilient hook members 80 adapted to be deflected laterally outwardly of a side wall 20 of the hull 12 to engage the underside 82 of one of the corrugations 28 in order to prevent vertical loads from disconnecting the bearing 42 from the hull 12. Such an arrangement advantageously eliminates the need of going through the costly operation of forming a transversal through hole in each side wall 20 of the hollow floating hull 12.

Each removable bearing 42 also comprises a cleat-like member 84 extending upwardly from a top surface of the bearing 42 to cooperate with a padlock 86 to lock the associated crank 44 and, thus, prevent unauthorized utilization of the watercraft 10. Each cleat-like member 84 comprises an upstanding plate 88 defining a through hole 90. The padlock 86 is of conventional construction and comprises a lock 92 and a U-shaped bar 94 rotatably hinged at one end thereof to the lock 92. The U-shaped bar 94 is adapted to be slipped into the hole 90 before the free end of the bar 94 be fastened to the lock 92 in order to lock the crank 44, as seen in FIG. 4.

As seen in FIG. 6, the paddle wheels 38 and associated actuating parts are sized and configured to be completely received in the cockpit 24, whereas the windshield 36 is configured to be fitted in superposition over the bow portion 16 of the hull 12 to allow the recreational watercraft 10 to be stored and shipped in a minimum of space. For instance, the watercraft 10 can be sold as a kit which fits in a relatively small rectangular box B having an internal volume generally corresponding to the outside volume of the hull 12.

What is claimed is:

1. A recreational watercraft comprising a hull and a propulsion unit for propelling said hull on a water surface, said propulsion unit comprising a pair of paddle wheels laterally mounted on opposed sides of said hull, each said paddle wheel including a plurality of vanes circumferentially distributed on a buoyant hub structure projecting laterally outwardly of said hull, each said buoyant hub structure acting as an outrigger float to provide additional lateral flotation stability, wherein said paddle wheels are independently mounted to said hull via two axles journaled in respective replaceable bearings mounted in corresponding depressions formed in opposed gunwales of said hull.

2. A recreational watercraft as defined in claim 1, wherein each of said vanes has a curved root following a curvature of said buoyant hub structure.

3. A recreational watercraft as defined in claim 2, wherein each said buoyant hub structure has a semi-spherical profile.

4. A recreational watercraft as defined in claim 3, wherein each said buoyant hub structure has a planar inboard facing surface which is perpendicular to an axis of rotation of a corresponding one of said paddle wheels.

5. A recreational watercraft as defined in claim 4, wherein a flange extends laterally outwardly of said inboard facing surface of each said buoyant hub structure.

6. A recreational watercraft as defined in claim 5, wherein each said vane has an inner edge extending to a corresponding one of said flanges.

7. A recreational watercraft as defined in claim 6, wherein each said vane has a convex radially outermost edge and a concave outer edge.

8. A recreational watercraft as defined in claim 1 further comprising a windshield detachably mounted to said hull so as to be automatically separated therefrom upon capsizing of said hull, said windshield being formed as a float to support a user on a water surface independently of said hull and of said propulsion unit.

9. A recreational watercraft as defined in claim 1, wherein said hull is provided in the form of a unitary hollow molded structure.

10. A recreational watercraft as defined in claim 1, wherein said replaceable bearings are adapted to be wedged in position in said depressions.

11. A watercraft paddle wheel comprising a plurality of radially extending vanes circumferentially distributed on an outer semi-spherical surface of a hub structure, wherein each said vane has a convex radially outermost edge and a concave outer edge.

12. A watercraft paddle wheel as defined in claim 11, wherein said outer semi-spherical surface has a planar inboard facing surface which extends at right angles to a rotation axis of said paddle wheel.

13. A watercraft paddle wheel as defined in claim 12, wherein each said vane has an inner end extending to a flange extending outwardly from said planar inboard facing surface.

14. A recreational watercraft comprising a hull and a windshield detachably mounted to said hull so as to be automatically separated therefrom upon capsizing of said hull, said windshield being formed as a float to support a user on a water surface independently of said hull.

15. A recreational watercraft as defined in claim 14, wherein said windshield is only seated in position on a top surface of said hull.

16. A paddle wheel for propelling a recreational watercraft through water, comprising an outboard structure having a planar inboard surface and a semi-spherical outboard surface, said planar inboard surface forming an annular ring about said semi-spherical outboard surface, a plurality of radially extending paddles circumferentially distributed on said semi-spherical outboard surface, each said paddle having an inboard end extending from said annular ring, said semi-spherical outboard surface and said annular ring cooperating with said paddles to constrictly channel bubbles trapped between submerged adjacent paddles laterally upwardly on an outboard side of the paddle wheel to a water surface where the bubbles burst, thereby producing audible bursting sounds as said paddle wheel is operated in the water.

17. A kit for a recreational watercraft comprising a hull defining a cockpit adapted to receive a child, a propeller assembly including a pair of paddle wheels adapted to be connected to said hull for propelling the same on a surface of water, said propeller assembly being sized and configured to be completely received within said cockpit for compact storage, and a windshield adapted to be removably mounted at a front end of said cockpit, said windshield being sized and configured to be fitted in superposition upon an outer surface of said hull to allow said recreational watercraft to be stored and shipped in a minimum of space.

* * * * *